United States Patent [19]

Ohshima et al.

[11] Patent Number: 4,687,723

[45] Date of Patent: Aug. 18, 1987

[54] ELECTROPHOTOGRAPHIC PHOTOCONDUCTOR HAVING A PHOTOSENSITIVE LAYER OF AMORPHOUS SILICON CARBONITRIDE

[75] Inventors: Kohichi Ohshima; Yoshiyuki Kageyama, both of Numazu; Yukio Ide, Mishima; Itaru Fujimura, Numazu; Masako Kunita, Fuji, all of Japan

[73] Assignee: Ricoh Company, Ltd., Tokyo, Japan

[21] Appl. No.: 821,832

[22] Filed: Dec. 17, 1985

Related U.S. Application Data

[63] Continuation-in-part of Ser. No. 676,806, Nov. 30, 1984, abandoned.

[30] Foreign Application Priority Data

Dec. 1, 1983 [JP] Japan ..... 58-225395

[51] Int. Cl.[4] ..... G03G 5/082

[52] U.S. Cl. ..... 430/65; 430/66; 430/84

[58] Field of Search ..... 357/30; 430/58, 84, 430/95, 65, 66

[56] References Cited

U.S. PATENT DOCUMENTS

| | | | |
|---|---|---|---|
| 4,476,346 | 10/1984 | Tawada et al. | 357/30 |
| 4,510,224 | 4/1985 | Yamazaki et al. | 430/84 |
| 4,536,459 | 8/1985 | Misumi et al. | 430/84 |
| 4,582,721 | 4/1986 | Yoshino et al. | 357/30 |

*Primary Examiner*—John L. Goodrow

*Attorney, Agent, or Firm*—Oblon, Fisher, Spivak, McClelland & Maier

[57] ABSTRACT

An electrophotographic photoconductor is disclosed, which comprises a support material, an intermediate layer, a photosensitive layer and a surface protection layer for protecting the photosensitive layer, which are successively overlaid on the support material, and the photosensitive layer comprises an amorphous silicon carbon nitride containing at least hydrogen or halogen having the formula of a-Si:C:N(H.X), where X represents halogen, or an amorphous silicon carbon nitride of the formula of a-Si:C:N:O(H.X) (where X represents halogen) which contains at least hydrogen or halogen.

17 Claims, 5 Drawing Figures

ELECTROPHOTOGRAPHIC PHOTOCONDUCTOR HAVING A PHOTOSENSITIVE LAYER OF AMORPHOUS SILICON CARBONITRIDE

The present application is a continuation-in-part of application Ser. No. 676,806, filed on Nov. 30, 1984.

BACKGROUND OF THE INVENTION

The present invention relates to an electrophotographic photoconductor, and more particularly to an electrophotographic photoconductor comprising a support material and a photoconductive layer formed thereon which comprises an amorphous silicon carbon nitride of the formula of a-Si:C:N(H.X) (where X represents halogen) which contains at least hydrogen or halogen or an amorphous silicon carbon nitride of the formula of a-Si:C:N:0(H.X) (where X represents halogen) which contains at least hydrogen or halogen.

Conventionally a-Si:C type photoconductor including a photoconductive layer comprising amorphous silicon carbide is known as a photoconductor whose energy gap Eg can be changed by changing the content of carbon (C), which has high hardness and excellent weathering resistance. As a representative example of such a-Si:C type photoconductors, a photoconductor having a photosensitive layer of the formula of a-$Si_xC_{1-x}$:H is known. This photoconductor, however, cannot be used in practice because of poor photosensitivity and chargeability. Furthermore, the durability of the a-Si:C type photoconductors is not sufficient for practical use and there is room for improvement on the durability. Specifically, a photoconductor of this type having a support material consisting of Al has the shortcoming that the photosensitive layer easily peels off the support material and the photoconductor cannot be used for an extended period of time.

SUMMARY OF THE INVENTION

It is therefore an object of the present invention to provide an electrophotographic photoconductor of the type comprising a support material and a photoconductive layer formed thereon, which photoconductive layer comprises an amorphous silicon carbon nitride of the formula of a-Si:C:N(H.X) (where X represents halogen), containing at least hydrogen or halogen or an amorphous silicon carbon nitride of the formula of a-Si:C:N:O(H.X) (where X represents halogen) which contains at least hydrogen or halgoen. The key features of the electrophotographic photoconductor according to the present invention are that the durability while in use is excellent, the photosensitivity is high, images haaving high image quality can be provided, and the photosensitive layer does not peel off the support material and no environment-pollution problems are caused while in use.

DETAILED DESCRIPTION OF THE PREFERRED EMBODIMENTS

As mentioned above, the electrophotographic photoconductor according to the present invention comprises a support material and a photoconductive layer formed thereon, and the photoconductive layer includes a photosensitive layer comprising an amorphous silicon carbon nitride of the formula of a-Si:C:N(H.X) (where X represents halogen), containing at least hydrogen or halogen, or an amorphous silicon carbon nitride of the formula of a-Si:C:N:0(H.X) (where X represents halogen) which contains at least hydrogen or halogen.

Figure 1:
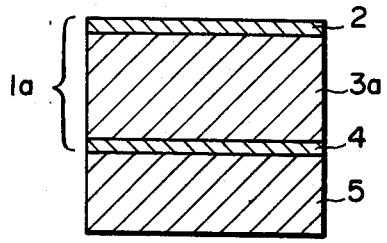
FIG. 1 shows a schematic cross-sectional view of an embodiment of an electrophotographic photoconductor according to the present invention.

Referring to FIG. 1, the structure of an embodiment of an electrophotographic photoconductor according to the present invention will now be explained.

As shown in the figure, this electrophotographic photoconductor comprises a support material 5 and a photoconductive layer 1*a* formed on the support material 5. The photoconductive layer 1*a* comprises a photosensitive layer 3*a*, a surface protection layer 2 for protecting the top surface of the photosensitive layer 3*a* and for reducing the reflection by the photosensitive layer 3*a* of the light incident thereon, and an intermediate layer 4 which is interposed between the photosensitive layer 3*a* and the support material 5, serving to block the injection of negative carriers or positive carriers (holes) into the photosensitive layer 3*a* through the support material 5.

Figure 2:
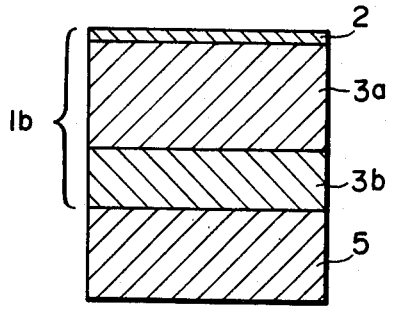
FIG. 2 shows a schematic cross-sectional view of another embodiment of an electrophotographic photoconductor according to the present invention.

FIG. 2 shows the structure of another embodiment of an electrophotographic photoconductor according to the present invention. As shown in the figure, the electrophotographic photoconductor comprises a support material 5 and a photoconductor conductive layer 1*b* formed on the support material 5. The photoconductive laayer 1*b* comprises a photosensitive layer 3*a*, a surface protection layer 2 for protecting the top surface of the photosensitive layer 3*a* and for reducing the reflection by the photosensitive layer 3*a* of the light incident thereon, and a p-type semiconductor layer 3*b* interposed between the photosensitive layer 3*a* and the support material 5.

The p-type semiconductor layer 3*b* serves to block the injection of negative carriers into the photosensitive layer 3*a* through the support material 5 in the course of positive charging prior to the formation of latent electrostatic images, thereby reducing the dark decay of the photosensitive layer 3*a*, but facilitates the dissipation of positive carriers through the support material when the photosensitive layer 3*a*, but facilitates the dissipation of positive carriers through the support material 5 when the photosensitive layer 3*a* is exposed to light images.

As a matter of course, the p-type semiconductor layer 3*b* can be replaced by a n-type semiconductor layer by which the injection of positive carriers (holes) into the photosensitive layer 3*a* through the support material 5 is blocked in the course of applicaation of negative change prior to the formation of electrostatic images, and the dissipation of negative carriers from the photosensitive layer 3*a* through the support material 5 is facilitated when the photosensitive layer 3b is exposed to light images.

Thus such n- and p-type semiconductor layers both serve as carrier blocking lauer in the photoconductive layer 1b.

As the materials for the support material in the present invention, there can be employed electroconductive materials such as Al, stainless steel, Ni, Cr, Mo, Au, Ir, Ta, Nb, Ti, V, Pt, Pt and alloys of such elements, and electroconductive materials consisting of (i) an electroconductive thin layer of at least one component selected from the group consisting of the above-mentioned metals and alloys, and a metal oxide such as $In_2O_3$ and $SnO_2$ and (ii) an electrically insulating support material for supporting the electroconductive thin layer, such as a sheet of paper or a polymeric material, for instance, polyester, polyethylene, polycarbonate, polypropylene, polyvinyl chloride and polystyrene, ceramics, or glass.

Further, in the present invention, it is preferable that the surface of the support material be made rough, for instance, with a roughness of about 0.05 μm to 1.0 μm in order to prevent the photoconductive layers la and lb from peeling off the support material 5, whereby the durability of the photoconductor can be increased.

In the present invention, the photosensitive layer 3a comprises the above-mentioned amorphous silicon carbide nitride. The amorphous silicon carbide nitride can be doped with at least one element selected from the group consisting of B, Al, Ga, In, and Tl of Group III-A and P, As, Sb and Bi of Group V-A in the table. By this doping, the electric properties of the photosensitive layer 3a can be controlled and changed, for example, to p-type or to n-type. It is preferable that the amount of such elements for doping the photosensitive layer 3a be 10 ppm to 10,000 ppm, more preferably 50 ppm to 5,000 ppm.

As the materials for the photosensitive layer 3a, a-Si:C:N:(H and/or X) (where X is halogen) is employed. In the present invention, it is essential that the photosensitive layer 3a is made of a material comprising at least a-Si, C, N, H and/or halogen. Therefore, for instance, a-Si:C:N:0(H.X) and a-Si:C:N:S(H.X) can also be employed in the present invention.

Generally, in order to increase the charging potential of a-Si photoconductors, there are two representative methods: The first method is to increase the electric resistance of the photosensitive layer itself. The second method is to prevent injection of carriers into the photosensitive layer from the support material and from the surface of the photosensitive layer.

Figure 4:
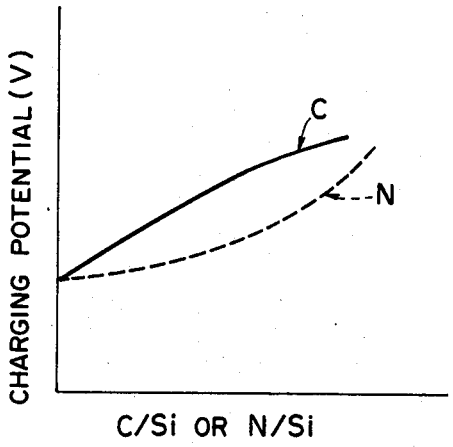
FIG. 4 shows the effects of the addition of carbon and nitrogen to a photoconductor on the charging potential of the photoconductor.

As mentioned above, the photosensitive layer employed in the present invention contains both C and N. In the present invention, by including both C and N, the above-mentioned first method is adopted, so that the electric resistance of the photosensitive layer is increased, thereby increasing the charging potential. The addition of C is particularly effective for increasing the charging potential, even if the added amount is very small as shown in FIG. 4.

Figure 5:
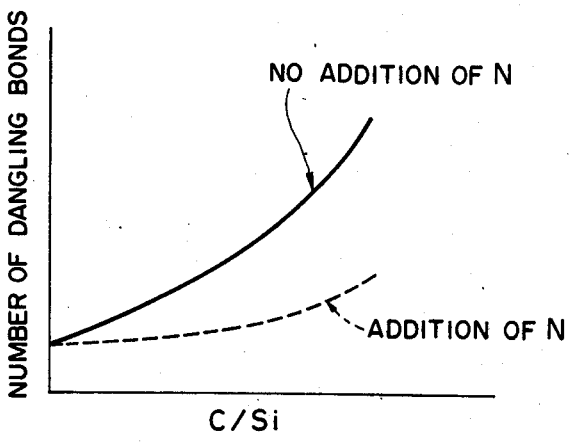
FIG. 5 shows the effect of the addition of nitrogen to a photoconductor on the number of dangling bonds in the photoconductor.

However, when only C (3-coordination element) is added, dangling bonds in the photoconductor increase, so that the photosensitivity markedly decreases. In the present invention, in order to prevent the formation of such dangling bonds, N (3-coordination element) is also added to the photoconductor. The effect of reducing the dangling bonds by the addition of N to the photoconductor is indicated in FIG. 5.

It is preferable that the thickness of the photosensitive layer 3a be in the range of 5 μm to 100 μm, more preferably in the range of 10 μm to 50 μm.

The surface protection layer protects the photosensitive layer 3a and reduces the reflection by the photosensitive layer 3a of the light incident thereon.

It is preferable that the surface protection layer to be formed on the top surface of photosensitive layer 3a have an index of refraction between the index of refraction of the air and the index of refraction of the photosensitive layer, preferably, n=1.44 to 2.30.

As the materials for the surface protection layer, for example, aluminum oxide ($Al_2O_3$), titanium oxide ($Tio_2$), silicon oxide ($Sio_2$), tin oxide ($Sno_2$), magnesium fluoride ($MgF_2$), tantalum oxide ($Ta_2O_3$) and mixtures of these materials can be employed. It is preferable that the thickness of the surface protection layer be in the range of 0.02 μm to 1.0 μm.

As the materials for the surface protection layer, for example, a-Si:N:H, a-Si:N:0:H, a-Si:C:0:H, a-Si:C:H, a-Si:C:N:0:H, B:N:H, B:N:0:H, B:C:N:H, a-Si:N:X, a-Si:N:0:X, a-Si:C:0:X, a-Si:C:X, a-Si:C:N:0:X, B:N:X, B:N:0:X and B:C:N:X (where X is halogen) can also be employed.

As mentioned previously, the intermediate layer 4 is interposed between the photosensitive layer 3a and the support material 5. The intermediate layer 4 blocks the injection of negative or positive carriers into the photosensitive layer 3a through the support material 5 during charge application thereto for the formation of latent electrostatic images, whereby the dark decay of the photosensitive layer 3a is reduced, and facilitates dissipation of positive or negative carriers from the photosensitive layer 3a through the support material 5 during the exposure thereof to light images.

In short, the intermediate layer 4 works as a carrier blocking layer in the photoconductive layer 1a.

As the materials for the intermediate layer 4, for example, a-Si:N:H, a-Si:N:0:H, a-Si:C:0:H, a-Si:C:H, a-Si:C:N:0:H, B:N:H, B:N:0:H, B:C:N:H, a-Si:N:X, a-Si:N:0:X, a-Si:C:0:X, a-Si:C:X, a-Si:C:N:0:X, B:N:X, B:N:0:X and B:C:N:X (where X is halogen) can be employed. It is preferable that the thickness of the intermediate layer 4 be in the range of 0.01 μm to 1 μm, more preferably in the range of 0.02 μm to 0.5 μm.

As mentioned previously, n- and p-type semiconductor layers also serve as carrier blocking layer in the photoconductive layer.

As the material for p-type semiconductor layer 3b, for example, a-Si:H:(B), can be employed, and as the material for the n-type semiconductor layer, for example, a-Si:H:(P) can be employed. It is preferable that the thickness of such semiconductor layer be in the range of 0.02 μm to 1.0 μm, more preferably in the range of 0.05 μm to 0.5 μm.

Figure 3:
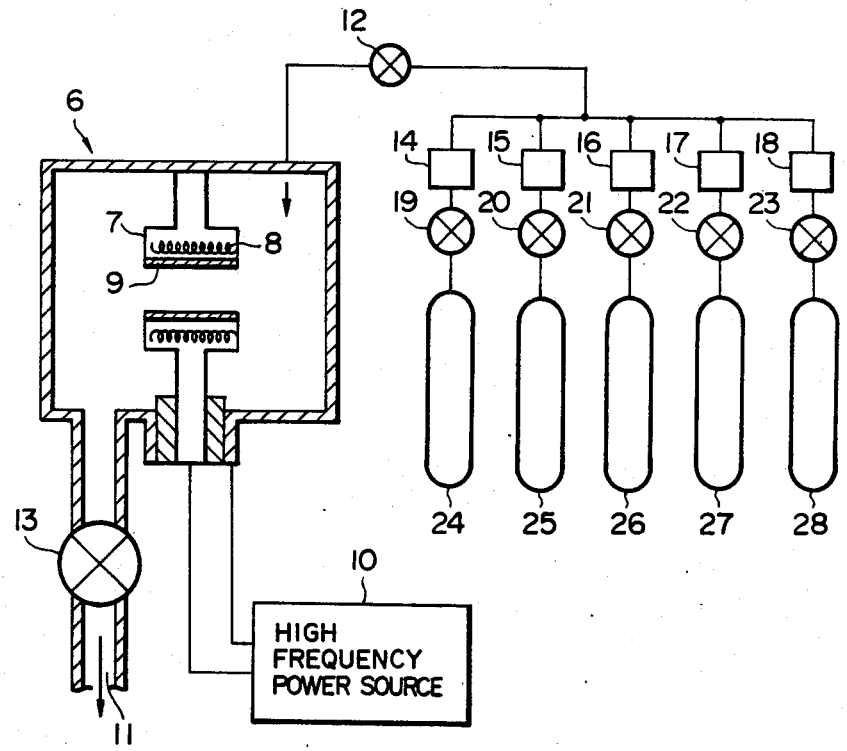
FIG. 3 shows a schematic diagram of a plasma glow discharge decomposition apparatus for producing the electrophotographic photoconductor according to the present invention.

The photoconductors according to the present invention can be prepared by use of a plasma glow discharge decomposition apparatus as schematically shown in FIG. 3. In this apparatus, a vacuum chamber 6 is connected to a high frequency power source 10. In the vacuum chamber 6, there is disposed an electrode 7 to which a support material 9 is attached. The vacuum chamber 6 is connected to gas cylinders 24 to 28 through gas valves 19 to 23, mass-flow controllers 14 to 18 and a gas valve 12.

The gas cylinder 24, 25, 26, 27 and 28 respectively contain, for instance, $SiH_4$ or $SiF_4$, or $NH_3$ or $CH_4$, $H_2$, and doping gases.

In accordance with the desired composition of the photoconductive layer to be formed on the support material 9, the necessary gases are supplied to the vacuum chamber 6 through the gas valves 19 to 23 and 12 while adjusting the mass flow controllers 14 to 18, so that the intermediate layer 4 or the semiconductor layer 3*b*, the photosensitive layer 3*a* and the surface protection layer are successively deposited on the support material 9. After the deposition of each layer, unnecessary decomposed gases are discharged from the vacuum chamber 6 through a main valve 13.

By referring to the following examples, embodiments of an electrophotographic photoconductor according to the present ihvention will now be explained.

EXAMPLE 1

An electrophotographic photoconductor No. 1 according to the present invention was prepared as follows:

Formation of Intermediate Layer

By use of the apparatus as shown in FIG. 3, an intermediate layer of a-Si:N:H having a thickness of 0.3 μm was formed on an aluminum drum having a surface roughness of 0.2 μm under the following conditions:

| Employed Gases | Flow Rate (sccm) |
|---|---|
| $SiH_4$ (20%)/$H_2$ | 500 |
| $N_2$ | 100 |

The density of the power applied to the gases for decomposition thereof through the high frequency power source was 0.25 W/cm$^2$.

During the course of the deposition of the intermediate layer on the aluminum drum, the temperature of the drum was maintained at 230° C. and the pressure in the vacuum chamber was maintained at 0.8 torr.

Formation of Photosensitive Layer

A photosensitive layer of a-Si:C:N:H(B) having a thickness of 20 μm was formed on the above-prepared a-Si:N:H intermediate layer under the following conditions:

| Employed Gases | Flow Rate (sccm) |
|---|---|
| $SiH_4$ (20%)/$H_2$ | 500 |
| $N_2$ | 20 |
| $CH_4$ | 10 |
| $B_2H_6$ (1000 ppm)/$H_2$ | 10 |

The density of the power applied to the above gases for decomposition thereof through the high frequency powder source was 0.20 W/cm$^2$. In the course of the deposition of the the photosensitive layer on the intermediate layer, the temperature of the aluminum drum was also maintained at 230° C. and the pressure in the vacuum chamber was also maintained at 0.8 torr.

Foramtion of Protective Layer

A protective layer of a-Si:O:H having a thickness of 0.3 μm was formed on the above formed photosensitive layer under the following conditions.

| Employed Gases | Flow Rate (sccm) |
|---|---|
| $SiH_4$ (20%)/$H_2$ | 500 |

-continued

| Employed Gases | Flow Rate (sccm) |
|---|---|
| $CO_2$ | 100 |

The density of the power applied to the above gases for decomposition thereof through the high frequency powder source was 0.20 W/cm$^2$. In the course of the deposition of the protective layer on the photosensitive layer, the temperature of the aluminum drum was also maintained at 230° C. and the pressure in the vacuum chamber was also maintained at 0.8 torr.

Thus, an electrophotographic photoconductor No. 1 according to the present invention was prepared

EXAMPLE 2

The procedure of Example 1 was repeated except that when preparing the photosensitive layer, $SiH_4$(20%)/$H_2$ employed in Example 1 was replaced by $SiF_4$ (20%)/$H_2$ so that a photosensitive layer of a-Si:C:N:F(B) having a thickness of 23 μm was prepared, whereby an electrophotographic photoconductor No. 2 according to the present invention was prepared.

EXAMPLE 3

The procedure of Example 1 was repeated except that the intermediate layer formed in Example 1 was replaced by a p-type semiconductor layer of a-Si:H:(B) having a thickness of 0.3 μm which was prepared under the following conditions, whereby an electrophotographic photoconductor No. 3 according to the present invention was prepared.

| Employed Gases | Flow Rate (sccm) |
|---|---|
| $SiH_4$ (20%)/$H_2$ | 500 |
| $B_2H_6$ (1,000 ppm)/$H_2$ | 30 |

Thus, the ratio of $B_2H_6/SiH_4$ was 300 volume ppm.

In connection with the above example, when a carrier blocking layer of the above p-type semiconductor is prepared, it is preferable that the ratio of $B_2H_6/SiH_4$ be in the range of 200 volume ppm to 1,000 volume ppm.

The electrophotographic photoconductor No. 1 through No. 3 according to the present invention were each incorporated in a commercially available copying machine (FT4060 made by Ricoh Company, Ltd.) and were subjected to a copying taste of making 50,000 copies. The result was that clear copies were made throughout the copying test and no peeling of the photoconductive layer off the aluminum drum was observed at all.

EXAMPLE 4

An electrophotographic photoconductor No. 4 according to the present invention as illustrated in FIG. 1 was prepared as follows:

Formation of Intermediate Layer

By use of the apparatus as shown in FIG. 3, an intermediate layer of a-Si:N:0:H having a thickness of 0.4 μm was formed on an aluminum drum having a surface roughness of 0.2 μm under the following conditions:

| Employed Gases | Flow Rate (sccm) |
|---|---|
| $SiH_4$ (20%)/$H_2$ | 500 |
| $N_2$ | 100 |

-continued

| Employed Gases | Flow Rate (sccm) |
|---|---|
| $CO_2$ | 50 |

The density of the power applied to the gases for decomposition thereof through the high frequency power source was 0.20 W/cm$^2$.

During the course of the deposition of the intermediate layer on the aluminum drum, the temperature of the drum was maintained at 230° C. and the pressure in the vacuum chamber was maintained at 0.6 torr.

Formation of Photosensitive Layer

A photosensitive layer of a-Si:C:N:H(B) having a thickness of 23 μm as formed on the above-prepared a-Si:N:0:H intermediate layer under the following conditions:

| Employed Gases | Flow Rate (sccm) |
|---|---|
| $SiH_4$ (20%)/$H_2$ | 500 |
| $N_2$ | 20 |
| $CH_4$ | 10 |
| $B_2H_6$ (1000 ppm)/$H_2$ | 10 |

The density of the power applied to the above gases for decomposition thereof through the high frequency powder source was 0.20 W/cm$^2$. In the course of the deposition of the the photosensitive layer on the intermediate layer, the temperature of the aluminum drum was also maintained at 230° C. and the pressure in the vacuum chamber was maintained at 0.8 torr.

Formation of Protective Layer

A protective layer of a-Si:0:H having a thickness of 0.2 μm was formed on the above formed photosensitive layer under the following conditions:

| Employed Gases | Flow Rate (sccm) |
|---|---|
| $SiH_4$ (20%)/$H_2$ | 500 |
| $CO_2$ | 100 |

The density of the power applied to the above gases for decomposition thereof through the high frequency powder source was 0.22 W/cm$^2$. In the course of the deposition of the protective layer on the photosensitive layer, the temperature of the aluminum drum was also maintained at 230° C. and the pressure in the vacuum chamber was maintained at 0.6 torr.

Thus, an electrophotographic photoconductor No. 4 according to the present invention was prepared.

The electrophotographic characteristics of this photoconductor were as follows:

| | |
|---|---|
| Saturated Charging Potential ($V_M$): | 630 V (at application of +6.5 KV) |
| Dark Decay Ratio after 20 sec ($V_1/V_M$): ($V_1$: Dark Decayed Potential) | 0.65 |
| Photosensitivity to White Light ($S_w$): | 0.9 J/cm$^2$ (Exposure required for decreasing the potential from 400 V to 100 V) |

The electrophotographic photoconductor No. 4 according to the present invention was incorporated in a commercially available copying machine (FT4060)made by Ricoh Company, Ltd.) and was subjected to a copying test of making 100,000 copies. The result was that clear copies were made throughout the copying test and the photosensitive layer did not peel off the aluminum drum. No deterioration of the electrophotographic characteristics was observed.

COMPARATIVE EXAMPLE 1

The procedure for Example 4 was repeated except that the intermediate layer was removed from the electrophotographic photoconductor No. 4 according to the present invention, whereby a comparative electrophotographic photoconductor No. 1 was prepared. This electrophotographic photoconductor was subjected to the above-mentioned copying test. The result was that from about 10,000th copy, the photosensitive layer slightly peeled off the aluminum drum. The electrophotographic characteristics were as follows:

| | |
|---|---|
| Saturated Charging Potential ($V_M$): | 520 V |
| Dark Decay Ratio after 20 sec ($V_1/V_M$): | 0.48 |
| Photosensitivity to White Light ($S_w$): | 1.0 J/cm$^2$ |

As compared with Example 4, the above three characteristics were all inferior to the electrophotographic characteristics of the electrophotographic photoconductor No. 4 according to the present invention.

COMPARATIVE EXAMPLE 2

The procedure for Example 4 was repeated except that the photosensitive layer employed in Example 4 was replaced by a-Si:C:H(B) photosensitive layer, whereby a comparative electrophotographic photoconductor No. 2 was prepared.

The electrophotographic characteristics were as follows:

| | |
|---|---|
| Saturated Charging Potential ($V_M$): | 480 V |
| Dark Decay Ratio after 20 sec ($V_1/V_M$): | 0.50 |
| Photosensitivity to White Light ($S_w$): | 2.0 J/cm$^2$ |

As compared with Example 4, the above three characteristics were again all inferior to the electrophotographic characteristics of the electrophotographic photoconductor No. 4 according to the present invention.

COMPARATIVE EXAMPLE 3

The procedure for Example 4 was repeated except that the protective layer was removed from the electrophotographic photoconductor No. 4, whereby a comparative electrophotographic photoconductor No. 3 was prepared. The electrophotographic characteristics were as follows:

| | |
|---|---|
| Saturated Charging Potential ($V_M$): | 550 V |
| Dark Decay Ratio after 20 sec ($V_1/V_M$): | 0.56 |
| Photosensitivity to White Light ($S_w$): | 1.50 J/cm$^2$ |

As compared with Example 4, the above three characteristics were also all inferior to the electrophotographic characteristics of the electrophotographic photoconductor No. 4 according to the present invention.

As mentioned previously, in the present invention, in order to prevent the formation of dangling bonds in the photoconductor for the purpose of increasing the charging potential of the photoconductor, N(3-coordination element) is added to the photoconductor.

It is also preferable to add to the photoconductor a very small amount of a 2-coordination element such as O (oxygen) in order to reduce the dangling bonds for the same purpose.

The following Example 5 shows the above effect of oxygen.

EXAMPLE 5

Formation of Intermediate Layer

By use of the apparatus as shown in FIG. 3, an intermediate layer of a-Si:C:N:0:H having a thickness of 0.3 μm was formed on an aluminum drum having a surface roughness of 0.1 μm under the following conditions:

| Employed Gases | Flow Rate (sccm) |
|---|---|
| $SiH_4$ (20%)/$H_2$ | 500 |
| $N_2$ | 100 |
| $C_2H_4$ | 40 |
| $CO_2$ | 50 |

The density of the power applied to the gases for decomposition thereof through the high frequency power source was 0.22 W/cm$^2$.

During the course of the deposition of the intermediate layer on the aluminum drum, the temperature of the drum was maintained at 240° C. and the pressure in the vacuum chamber was maintained at 0.6 torr.

Formation of Photosensitive Layer

A photosensitive layer of a-Si:C:N:0:H(B) having a thickness of 25 μm formed on the above-prepared a-Si:C:N:O:H intermediate layer under the following conditions:

| Employed Gases | Flow Rate (sccm) |
|---|---|
| $SiH_4$ (20%)/$H_2$ | 500 |
| $C_2H_4$ | 10 |
| $N_2$ | 20 |
| $CO_2$ | 10 |

The density of the power applied to the above gases for decomposition thereof through the high frequency powder source was 0.20 W/cm$^2$. In the course of the deposition of the the photosensitive layer on the intermediate layer, the temperature of the aluminum drum was also maintained at 240° C. and the pressure in the vacuum chamber was also maintained at 0.8 torr.

Formation of Protective Layer

A protective layer of a-Si:0:H having a thickness of 0.2 μm was formed on the above formed photosensitive layer under the following conditions:

| Employed Gases | Flow Rate (sccm) |
|---|---|
| $SiH_4$ (20%)/$H_2$ | 500 |

-continued

| Employed Gases | Flow Rate (sccm) |
|---|---|
| $CO_2$ | 100 |

The density of the power applied to the above gases for decomposition thereof through the high frequency powder source was 0.22 W/cm$^2$. In the course of the deposition of the protective layer on the photosensitive layer, the temperature of the aluminum drum was also maintained at 240° C. and the pressure in the vacuum chamber was also maintained at 0.6 torr.

Thus, an electrophotographic photoconductor No. 5 according to the present invention was prepared.

The electrophotographic characteristics of this photoconductor were as follows:

| | |
|---|---|
| Saturated Charging Potential ($V_M$): | 670 V (at application of + 6.5 KV) |
| Dark Decay Ratio | 0.65 |
| Photosensitivity to White Light ($S_W$) | 1.0 J/cm$^2$ |

The electrophotographic photoconductor No. 5 was subjected to the same copying test of making 100,000 copies as mentioned previously. The result was that clear copies were made throughout the copying test and the photosensitive layer did not peel off the aluminum drum. Further, no deterioration of the electrophotographic characteristics was observed.

It is preferable that an oxygen-containing a-Si photoconductor be an a-Si photoconductor having the formula of a-$Si_xC_yN_zO_l$(H.X), where, when $x+y+z+l=1$, $0.6 \leqq x \leqq 0.99$, $0.005 \leqq y \leqq 0.3$, $0.005 \leqq z \leqq 0.3$, and $0 < l \leqq 0.3$ in terms of atomic ratio.

Further, it is preferable that the intermediate layer contain O, for instance, as in a-Si:N:0:H and a-Si:C:0:H, since the compound containing O can be deposited more closely on the aluminum substrate as compared with a-Si:N:H and a-Si:C:H.

What is claimed is:

1. An electrophotographic photoconductor comprising a support material, an intermediate layer formed on said support material, a photosensitive layer formed on said intermediate layer, and a surface protection layer formed on said photosensitive layer for protecting the surface of said photosensitive layer and for reducing the reflection by said photosensitive layer of the light incident thereon, said photosensitive layer comprising an amorphous silicon carbon nitride selected from the group consisting of an amorphous silicon carbon nitride containing at least one hydrogen or halogen having the formula of a-Si:C:N(H.X), where X represents halogen, and an amorphous silicon carbon nitride of the formula of a-Si:C:N:O(H.X), where X represents halogen, which contains at least hydrogen or halogen, and said intermediate layer comprising a material selected from the group consisting of a-Si:N:H, a-Si:N:O:H, a-Si:C:O:H, a-Si:C:N:O:H, B:N:H, B:N:O:H, B:C:N:H, a-Si:n:X, a-Si:N:O:X, a-Si:C:O:X, a-Si:C:X, a-Si:C:N:O:X, B:N:X, B:N:O:X and B:C:N:X, where X is halogen.

2. An electrophotographic photoconductor as claimed in claim 1, wherein said amorphous silicon carbon nitride is doped with at least one element selected from the group of B, Al, Ga, In, Tl, P, As, Sb, and Bi in an amount ranging from 10 ppm to 10,000 ppm.

3. An electrophotographic photoconductor as claimed in claim 1, wherein said intermediate layer is formed from a-Si:N:O:H or a-Si:C:O:H.

4. An electrophotographic photoconductor as claimed in claim 1, wherein said intermediate layer comprises an n-type semiconductor.

5. An electrophotographic photoconductor as claimed in claim 1, wherein said intermediate layer comprises a p-type semiconductor.

6. An electrophotographic photoconductor as claimed in claim 4, wherein said intermediate layer comprises a material having the formula of a-Si:H:(P).

7. An electrophotographic photoconductor as claimed in claim 5, wherein said intermediate layer comprises a material having the formula of a-Si:H:(B).

8. An electrophotographic photoconductor as claimed in claim 1, wherein said surface protection layer has an index of refraction between the index of refraction of the air and the index of refraction of said photosensitive layer.

9. An electrophotographic photoconductor as claimed in claim 1, wherein said surface protection layer has an index of refraction ranging from 1.44 to 2.30.

10. An electrophotographic photoconductor as claimed in claim 1, wherein said surface protection layer is made of a material selected from the group consisting of aluminum oxide ($Al_2O_3$), titanium oxide ($TiO_2$), silicon oxide ($SiO_2$), tin oxide ($SnO_2$), magnesium fluoride ($MgF_2$), tantalum oxide ($Ta_2O_3$) and mixtures of said materials.

11. An electrophotographic photoconductor as claimed in claim 1, wherein said surface protection layer is made of a material selected from the group consisting of a-Si:N:H, a-Si:N:0:H, a-Si:C:0:H, a-Si:C:H, a-Si:C:N:0:H, B:N:H, B:N:0:H, B:C:N:H, a-Si:N:X, a-Si:N:0:X, a-Si:C:0:X, a-Si:C:X, a-Si:C:N:0:X, B:N:X, B:N:0:X and B:C:N:X, where X is halogen.

12. An electrophotographic photoconductor as claimed in claim 1, wherein said amorphous silicon carbon nitride has the formula of a-$Si_xC_yN_zO_l$(H.X) where, when $x+y+z+l=1$, $0.6 \leqq x \leqq 0.99$, $0.005 \leqq y \leqq 0.3$, $0.005 \leqq z \leqq 0.3$ and $0 \leqq l \leqq 0.3$ in terms of atomic ratio.

13. An electrophotographic photoconductor as claimed in claim 1, wherein the thickness of said intermediate layer is in the range of from 0.01 μm to 1.0 μm.

14. An electrophotographic photoconductor as claimed in claim 4, wherein the thickness of said intermediate layer is in the range of from 0.02 μm to 0.5 μm.

15. An electrophotographic photoconductor as claimed in claim 5, wherein the thickness of said intermediate layer is in the range of from 0.02 μm to 0.5 μm.

16. An electrophotographic photoconductor as claimed in claim 1, wherein the thickness of said photosensitive layer is in the range of from 5μm to 100 μm.

17. An electrophotographic photoconductor as claimed in claim 1, wherein the thickness of said surface protection layer is in the range of from 0.02 μm to 1.0 μm.

* * * * *